US006360064B1

(12) United States Patent
Regelsberger et al.

(10) Patent No.: US 6,360,064 B1
(45) Date of Patent: Mar. 19, 2002

(54) ELECTROSTATOGRAPHIC IMAGE-FORMING APPARATUS AND METHOD FOR REDUCING TRANSFER ROLLER ARTIFACT BY PARKING TRANSFER ROLLER AT OR NEAR SEAM ON ENDLESS IMAGING MEMBER

(75) Inventors: Matthias H. Regelsberger; Anne F. Lairmore; Alfred Gonnella, Jr., all of Rochester, NY (US)

(73) Assignee: Nexpress Solutions LLC, Rochester, NY (US)

( * ) Notice: Subject to any disclaimer, the term of this patent is extended or adjusted under 35 U.S.C. 154(b) by 0 days.

(21) Appl. No.: 09/510,251

(22) Filed: Feb. 22, 2000

(51) Int. Cl.[7] ..... G03G 15/00
(52) U.S. Cl. ..... 399/162; 399/313
(58) Field of Search ..... 399/26, 36, 67, 399/101, 162–165, 313

(56) References Cited

U.S. PATENT DOCUMENTS 4,556,311 A 12/1985 Tagoku
4,860,054 A 8/1989 Higachi
5,255,055 A 10/1993 Mahoney
5,659,855 A 8/1997 Stelter et al. ..... 399/205
6,002,906 A 12/1999 Hino et al. ..... 399/303
6,055,396 A * 4/2000 Pang ..... 399/164
6,014,158 A 11/2000 Ziegelmuller et al. ..... 347/142
6,160,980 A * 12/2000 Ziegelmuller et al. ..... 399/303

* cited by examiner

*Primary Examiner*—William J. Royer

(57) ABSTRACT

An electrostatographic recording apparatus and method wherein a primary image forming member (PIFM) is moved along a closed path. The PIFM is sufficiently large to form a series of images thereon in the direction of movement of the PIFM during a production run. Plural series of toner images are formed on the PIFM during production runs. The toner images are transferred from the PIFM by engaging the PIFM with a transfer device. A cycle-down of the apparatus is provided to stop movement of the PIFM so that the PIFM is stopped to park the transfer device in a predetermined location on the PIFM preferably a seam area of the PIFM.

13 Claims, 8 Drawing Sheets

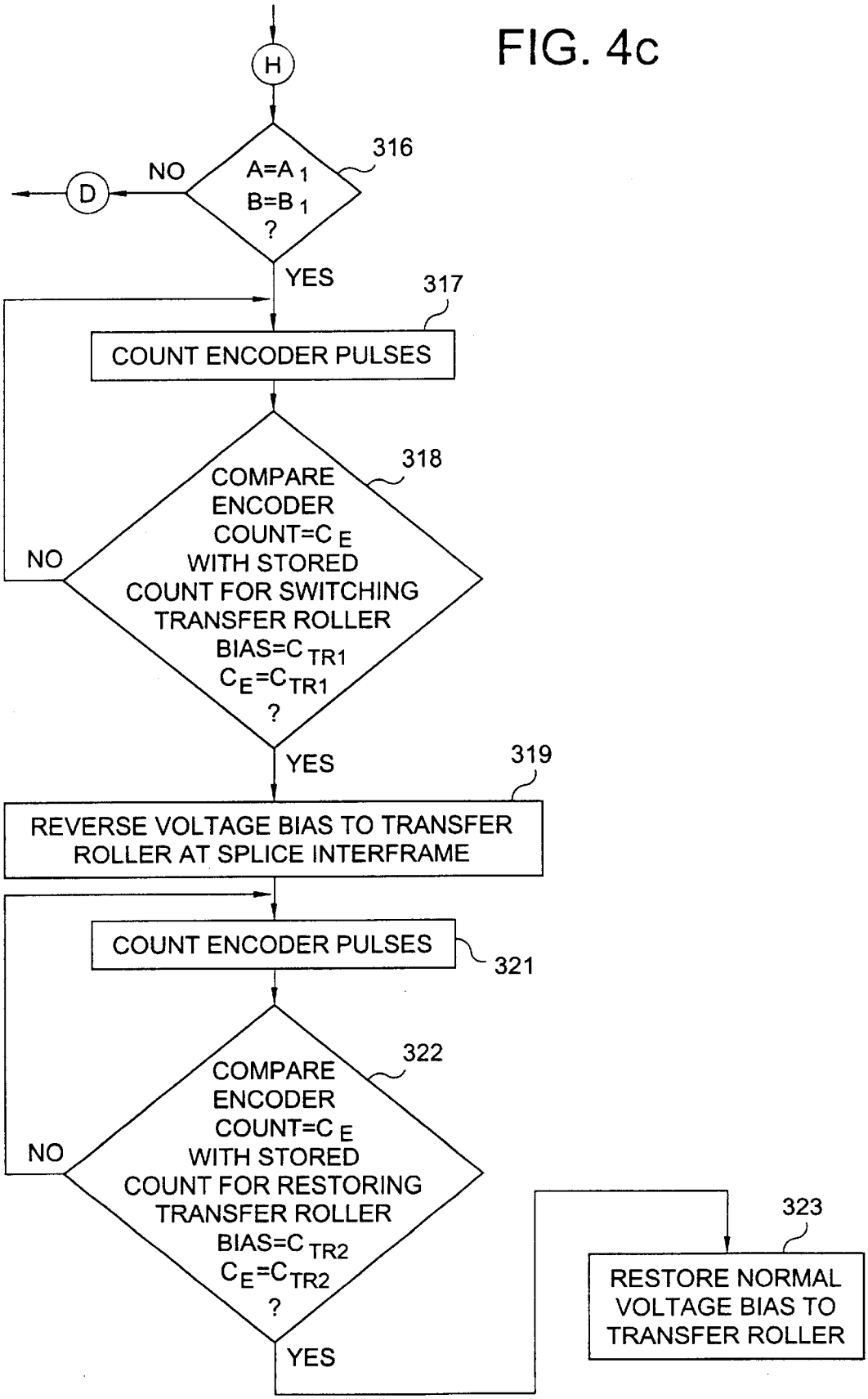
FIG. 4c
H
316
A=A 1
B=B 1
?
NO
D
YES
317
COUNT ENCODER PULSES
318
COMPARE
ENCODER
COUNT=C E
WITH STORED
COUNT FOR SWITCHING
TRANSFER ROLLER
BIAS=C TR1
C E=C TR1
?
NO
YES
319
REVERSE VOLTAGE BIAS TO TRANSFER
ROLLER AT SPLICE INTERFRAME
COUNT ENCODER PULSES
321
322
COMPARE
ENCODER
COUNT=C E
WITH STORED
COUNT FOR RESTORING
TRANSFER ROLLER
BIAS=C TR2
C E=C TR2
?
NO
YES
323
RESTORE NORMAL
VOLTAGE BIAS TO
TRANSFER ROLLER

ELECTROSTATOGRAPHIC IMAGE-FORMING APPARATUS AND METHOD FOR REDUCING TRANSFER ROLLER ARTIFACT BY PARKING TRANSFER ROLLER AT OR NEAR SEAM ON ENDLESS IMAGING MEMBER

FIELD OF THE INVENTION

This invention relates to electrostatographic reproduction apparatus such as copiers and printers, and more particularly to such a copier or printer that includes an imaging member having imaging and non-imaging portions and methods of use therewith.

DESCRIPTION OF THE PRIOR ART

Electrostatographic reproduction apparatus for producing copies of an original document are well known. Such copies typically are produced on suitable receiver sheets through a repeatable process that normally includes the steps of: (1) using electrostatic charges and first and/or second stations in some manner to form a latent image on the surface of an imaging or image-bearing member; (2) developing the latent image at a third station with developer material that includes toner particles; (3) transferring the developed image at a fourth station from the imaging member to a suitable receiver sheet for subsequent fusing; and (4) cleaning the image-bearing surface of the imaging member thereafter at a fifth station by removing residual toner and other particles therefrom.

In such reproduction apparatus in which the imaging member is repeatedly reused, ordinarily the imaging member has an endless shape for example in the form of a drum or of a flexible web. The endless flexible web form has certain advantages and disadvantages relative to the drum form. Among the advantages is the fact that such a flexible web can be disposed in a flat orientation along one portion thereof and in a curved orientation along another portion thereby facilitating placement of operating stations thereabout. More importantly, the flexible web form of an imaging member can allow for multiple images to be in the formation process at any given time and still retain some compactness and overall machine size.

Among the disadvantages, however, is the presence of a web splice or seam, that is where two ends of the web material usually have been splice-joined together in order to form its endless shape. Unfortunately, the portion of the web including an area immediately adjacent to either side of the splice may be not suitable for forming quality images, and so is regarded as a non-imaging area. Accordingly, in order to avoid forming images on such a non-imaging area, it is conventional to move the web about its path in the reproduction apparatus until the splice is detected by a detector located at a fixed location selected so that the imaging portion of the web is then in a position to run in proper registration with the fixed electrostatographic process stations of the apparatus as described above. The splice may be detected by the detector by providing on the web adjacent to the splice area a permanent mark or indicium such as a perforation or patch of density that can be detected by the detector.

In U.S. application Ser. No. 081841,008, filed on Apr. 29, 1997, in the names of Ziegelmuller et al, there is disclosed an electrophotographic recording apparatus wherein contamination of the transfer roller is reduced. The transfer roller is normally electrically biased to attract toner particles forming an image on a photoconductive web or belt. The electrical voltage bias or potential on the transfer roller is such as to attract the electrostatically charged toner particles forming the developed image to the receiver sheet which is advanced into a nip formed between the photoconductive web or belt and the transfer roller. In order to control process setpoints for the various electrophotographic operating stations, it is desirable to record process control patches and develop the patches with toner particles. It is not usually desirable to transfer these patches to a receiver sheet, so the patches are typically measured for density and then removed from the photoconductive belt. In order to maintain productivity of the machine, it is desirable to form the process control patches in areas of the belt not overlapping with image areas so that the image areas can be used for recording images. A problem with operating a photoconductive web at high speed is that in order to minimize contamination of the transfer roller when engaging a process control patch or area that tends to collect toner, such as a seam, it is desirable to reverse bias the transfer roller so that the roller tends to repel the charge on the toner particles and thereby avoids attracting the toner particles from the patch or the seam onto the transfer roller.

The inventors have noted that use of a transfer roller can cause artifacts to develop on recorded images. The invention disclosed herein overcomes this problem.

The above and other objects and advantages will become more apparent upon reading of a detailed description of the preferred embodiments of the invention provided below.

SUMMARY OF THE INVENTION

In accordance with the present invention there is provided an electrostatographic recording apparatus comprising a primary image forming member (PIFM) moving along a closed path, the PIFM including a seam, a toner image recorder that forms toner images on the PIFM during a production run of image formation, a transfer device in engagement with the PIFM for transferring the toner images from the PIFM, and a controller that is programmed to control movement of the PIFM during a cycle-down of the apparatus so that the PIFM is stopped in a position where the transfer device is parked on or near the seam.

In accordance with a second aspect of the invention, there is provided a method of recording with an electrostatographic recording apparatus, the method comprising moving a primary image forming member (PIFM) along a closed path, forming toner images on the PIFM during a production run of image formation, transferring the toner images from the PIFM by engaging the PIFM with a transfer device, and providing a cycle-down of the apparatus to stop movement of the PIFM, the PIFM being stopped to park the transfer device in a predetermined location on the PIFM.

BRIEF DESCRIPTION OF THE DRAWINGS

In the detailed description of the invention presented below, reference is made to the drawings, in which:

FIGS. 4*a*, 4*b* and 4*c* are a flow chart illustrating steps of control of the machine in accordance with a belt having different size interframes;

DETAILED DESCRIPTION OF THE INVENTION

Because electrostatographic reproduction apparatus are well known, the present description will be directed in particular to elements forming part of or cooperating more directly with the present invention. Apparatus not specifically shown or described herein are selectable from those known in the prior art.

While the invention will be described with reference to an electrophotographic system, the invention can also be used in an electrographic system too and thus is useful in electrostatography in general.

Figure 1:
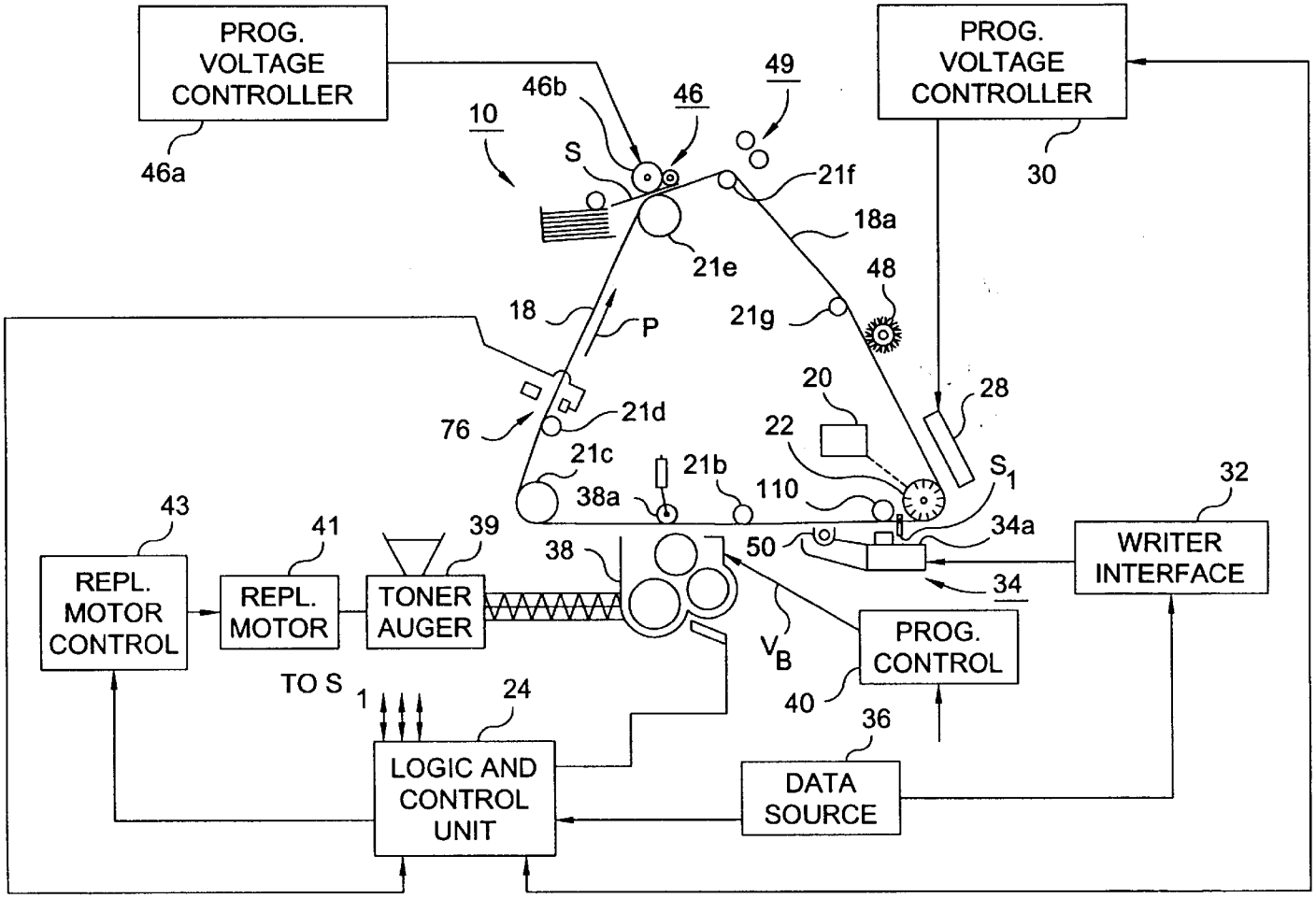
FIG. 1 is a schematic of an electrostatographic reproduction machine such as an electrophotographic printer embodying the present invention.

With reference to the electrostatographic copier and/or printer machine 10 shown in FIG. 1, an endless imaging member such as a photoconductive belt 18 is entrained about a plurality of rollers or other supports 21 *a–g*, one or more of which are driven (roller 21*a* is illustrated as being driven and roller 21*b* functioning as an encoder wheel) by a motor 20 so as to advance the belt preferably at a high speed, such as 20 inches per second or higher in a direction indicated by an arrow P past a series of workstations of the copier/printer machine. Alternatively, the belt may be wrapped and secured about only a single drum. The logic and control unit (LCU) 24, which has a digital computer, has a stored program for sequentially actuating the workstations in response to signals from various sensors and encoders as is well known.

The LCU includes a microcomputer and provides overall control of the apparatus and its various subsystems as is well known. Programming of a commercially available microprocessor is a conventional skill well understood in the art.

Briefly, a primary charging station 28 sensitizes belt 18 by applying a uniform electrostatic charge of a predetermined primary voltage to the surface 18*a* of the belt. The output of the charging station is regulated by a programmable voltage controller 30, which is in turn controlled by LCU 24 to adjust primary voltage, for example, through control of electrical potential to a grid that controls movement of corona charge from high-voltage charging wires to the surface of the recording member as is well known. Other forms of chargers, including brush or roller chargers, may also be used.

At an exposure station 34, projected light from a writer 34*a* selectively dissipates the electrostatic charge on the photoconductive belt to form a latent electrostatic image of the document to be copied or printed. The writer preferably has an array of light emitting diodes (LEDs) or other light source such as a laser or other spatial light modulator for exposing the photoconductive belt picture element (pixel) by picture element with a regulated intensity and exposure. Alternatively, the exposure may be by optical projection of an image of the document onto the photoconductive belt.

Where an LED or other electro-optical exposure source or writer is used, image data for recording is provided by a data source 36 for generating electrical image signals. The data source 36 may be a computer, a document scanner, a memory, a data network, etc. Signals from the data source and/or LCU also provide control signals to a writer interface 32 for identifying exposure correction parameters. Travel of belt 18 brings the areas bearing latent charge images into a development station 38. The development station has a magnetic brush in juxtaposition to, but spaced from, the travel path of the belt. Magnetic brush development stations are well known but other types of development stations or devices may be used as is also well known and plural development stations may be provided for developing images in plural colors or with toners of different physical characteristics.

LCU 24 selectively activates the development station in relation to the passage of the image areas containing latent images. Preferably, this activation may be made by having the LCU control a mechanism for moving a backup roller 38*a* to cause the belt with the electrostatic images thereon to be moved into engagement with or a small spacing from the magnetic brush. Alternatively, the magnetic brush may be moved toward the belt to selectively move into engagement with or a small spacing from the magnetic brush. The charged toner particles of the magnetic brush are selectively attracted to the latent image patterns to develop the image patterns.

As is well known in the art, conductor portions of the development station, such as conductive applicator cylinders, act as electrodes. The electrodes are connected to a variable supply of DC potential $V_B$ regulated by a programmable controller 40. Details regarding the development station are provided as an example, but are not essential to the invention. It is preferred that the development station contain a two component developer mix which comprises a dry mixture of toner and carrier particles. Typically the carrier preferably comprises high coercivity (hard magnetic) ferrite particles. As an example, the carrier particles have a volume-weighted diameter of approximately thirty micrometers. The dry toner particles are substantially smaller and of the order of 6–15 micrometers in volume-weighted diameter. The development station may include an applicator having a rotatable, magnetic core within a shell, which also may be rotatably driven by a respective motor or other suitable driving means. Rotation of the core and shell moves the developer through a development zone in the presence of an electrical field. In the course of development, the toner selectively electrostatically adheres to the photoconductive belt to develop the electrostatic images thereon and the carrier remains with the development station. As toner is depleted from the development station due to the development of the electrostatic image, additional toner is periodically introduced into the development station by toner auger 39 to be mixed with the carrier particles to maintain a uniform amount of development mixture. Auger 39 is driven by motor 41 which, in turn, is controlled by motor control 43. This development mixture is controlled in accordance with various development control processes, which are well known in the art. Single component developer stations as well as known development stations employing liquid toners may also be used. Subsequent to development, a backup erase may be provided for erasing charge on the image member.

A transfer station 46, as is well known, is provided for serially moving receiver sheets S into engagement with the photoconductive belt in register with a respective developed image for transferring the respective developed image to the respective receiver sheet. The receiver sheets may be plain or coated paper or of plastic. A transfer station may include a charging device for electrostatically biasing movement of toner particles on the belt to a receiver sheet. The biasing device may be a roller 46*b* that engages the back of the sheet and is connected to a programmable voltage controller 46*a* that can be operated in a constant current mode during transfer. Alternatively an intermediate member may have the image transferred to it and the image may then be transferred to the receiver sheet. A cleaning station 48 in the form of a brush, blade or web as is well known, is also provided subsequent to the transfer station for removing toner from the belt 18 to allow reuse of the belt surface for forming additional images. A preclean charger may be located before or at the cleaning station to facilitate cleaning. After transfer of the unfixed toner images to a receiver sheet, the sheet is detacked from the belt and transported to a fuser station 49 where the image is fixed. Alternatively, the image may be fixed at the time of transfer.

The LCU provides overall control of the apparatus and its various subsystems as is well known. The LCU may comprise temporary data storage memory, a central processing unit, timing and cycle control unit, and stored program control. Data input and output is performed sequentially through or under program control. Input data are applied either through input signal buffers to an input data processor or through an interrupt signal processor. The input signals are derived from various switches, sensors, and analog-to-digital converters that are part of the apparatus or received from sources external to the machine 10 as is well known.

The output data and control signals are applied directly or through storage latches to suitable output drivers. The output drivers are connected to appropriate subsystems.

Process control strategies generally utilize various sensors to provide real-time control of the electrostatographic process and to provide "constant" image quality output from the user's perspective.

One of such sensors may be a densitometer 76 to monitor development of test patches in non-image areas of photoconductive belt 18, as is well known in the art, see for example U.S. Pat. No. 5,649,266. The densitometer is intended to ensure that the transmittance or reflectance density of a toned patch on the belt is maintained. The densitometer may be comprised of an infrared or visible LED, which shines through the belt or is reflected by the belt onto a photodiode. A program stored in the LCU causes the machine to generate toned patches on the belt periodically. These patches are typically formed in interframe areas on the belt. They may be formed by enabling the LED printhead or other electro-optical exposure source to expose one or more portions of an interframe area of the photoconductor which has previously been uniformly charged by the primary charging device. The exposed area is then transported through the development zone wherein the discharged areas of the interframe area are developed to form the toned patch areas. Toned patches of different density may be formed. By having the toned patches formed in the interframe area the image areas may simultaneously be used for generating images that are transferred to receiver sheets without also transferring a toned patch area to a receiver sheet. Where the densitometer shines light through the belt, it is desirable to null out the density of the belt. As it is preferred to have the densitometer fixed in position, the density of the belt itself at the interframe used for recording a patch can be measured during a prior or subsequent revolution of the belt and subtracted from the density measurement of the toned patch.

A second sensor useful for monitoring process parameters is an electrometer probe 50 which is mounted at a location preferably downstream of the primary charging station 28 relative to the direction of movement of the belt 18 which direction is indicated by the arrow P. An example of an electrometer is described in U.S. Pat. No. 5,956,544.

Figure 2:
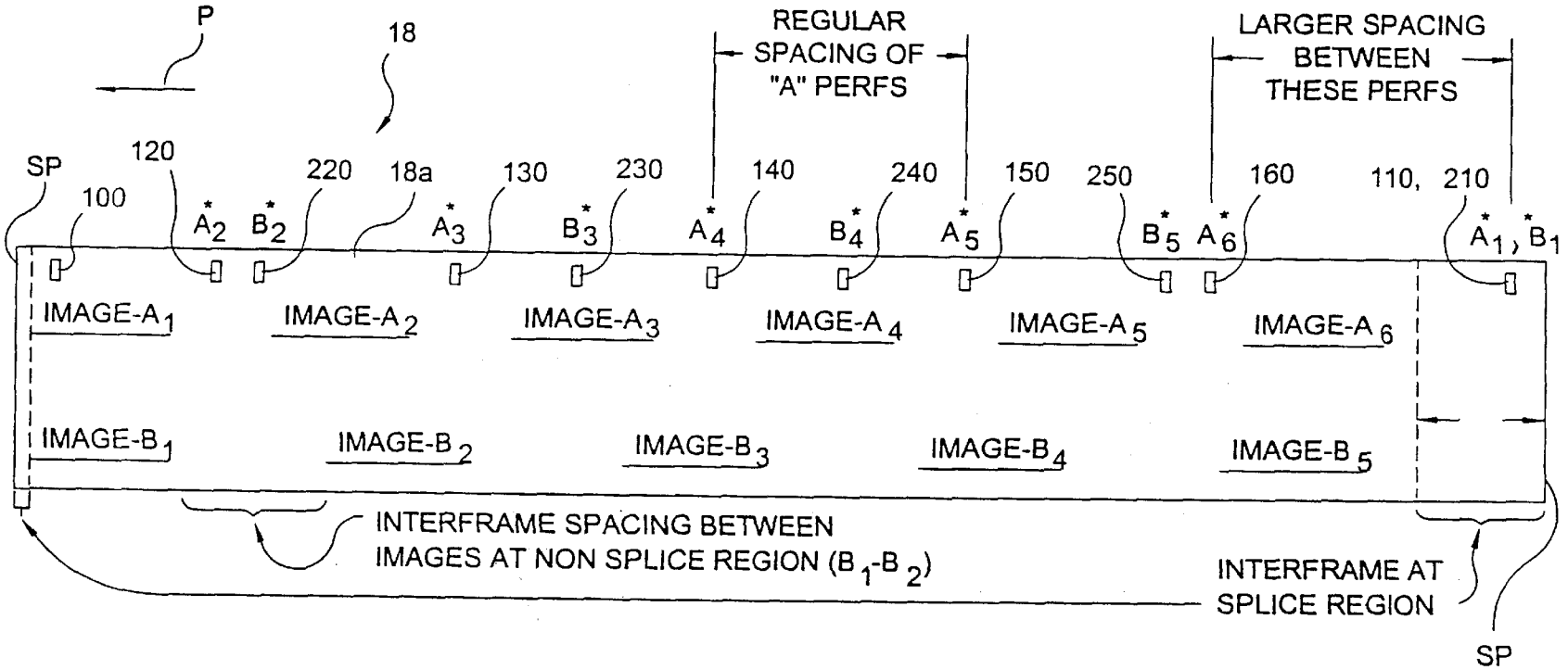
FIG. 2 is a schematic representation of a first embodiment of a photoconductive belt of the invention that has been cut at the seam so that the belt may be shown in a flat condition.

Referring now to FIG. 2, the endless imaging member belt or web 18 of the present invention is relatively long and includes a single splice shown as SP. The splice SP is where two ends of the web material have been splice-joined together in order to form its endless shape. As is well known, the splice may be formed by slightly overlapping the two ends and adhesively or ultrasonically joining them together. Alternatively, the splice may be formed by butting the two ends and connecting them with tape or adhesive. Also, contemplated is use of interlocking shapes formed in the ends allowing the ends to be joined and then sealed. The splice can be formed perpendicular to the movement direction P of the belt or skewed at an angle relative thereto as is well known. Elsewhere on the imaging member 18, away from the splice SP, the surface 18*a* of the imaging member 18 has or is nominally divisible into a plural number of imaging portions or image frames which are shown as $A_1$, $A_2 \ldots A_6$ and $B_1$, $B_2 \ldots B_5$ in each of FIGS. 2 and 3. Each imaging portion or image frame as such has a predetermined length for nominally occupying a predetermined area of the surface 18*a*. The imaging member 18 also includes a non-imaging portion consisting of a relatively narrow band of the surface 18*a* immediately adjacent to each side of the splice SP. There are, of course, no physical and actual dividing marks between any of such image frames, instead the surface 18*a* from the beginning of image frame $A_1$ to the end of image frame $A_6$ is uniform and continuous with a continuous portion thereof occupying a distance along the fixed path of the member 18 relative to each of the process stations described above when the member 18 is properly registered along such path. As such, six (6) images of size A (5 of size B) can be produced consecutively at spaced locations on the continuous section, one per each such portion or image frame, when the member 18 is fully imaged during one complete revolution around the fixed path.

For such fill imaging, it is necessary to start out with the imaging belt 18 in a properly registered position as shown for example in FIG. 1. In such a registered position, the imaging portions or frames each occupy a distance or portion of the fixed path so as to each be in proper working relationship relative to each one of the processing stations mounted fixedly along such distance of the path as described above, and more importantly, the non-imaging portion including the splice SP occupies a distance or portion of the fixed path such that no image will be formed over the splice or over such non-imaging portion (or interframe portion). As shown, such registration is achieved at a moment when a third sensor, for example, $S_1$, which is mounted fixedly at a first registration point along the fixed path of belt 18, senses a valid frame indicium or indicating means as passing by such sensor $S_1$ at such moment. As shown in FIG. 2 indicia or indicating means such as a perforation (or perf) (110, 210, 120, 220, 130, 230, 140, 240, 150, 250, 160) may be formed preferably within the non-imaging portion of the member 18 (interframe area or splice area) such that the indicia move with movement of the surface 18*a* into sensing relationship with the stationary sensor $S_1$. In FIG. 2, the perfs are also identified $A^*_1$–$A^*_6$ and $B^*_1$–$B^*_5$ to illustrate correspondence with respective image frames. An indicium 100 is also formed at a predetermined location in the splice area for sensing and control accordingly in order to properly locate the splice. The sensor $S_1$, like other components of the printing machine 10 is connected to the logic and control unit (LCU) 24. As such, an output signal from the sensor $S_1$ indicating the momentary sensing of the presence of the splice SP at the sensor $S_1$ can be fed to the LCU 24 for use in initiating and controlling the functioning and operation relative to imaging member 18 of the process stations as described above. Although the indicating means within the non-imaging portions are described as perfs, it is understood that other appropriate types of indicia or marks such as reflective marks can also be used cooperatively with an appropriate sensor for sensing such marks. The indicia are all formed in one row (splice indicium 100 included) adjacent one longitudinal edge and each one of the same size. Preferably, the indicia are formed in a ground stripe that runs adjacent this edge on the imaging member 18. The indicia need not be formed in the ground stripe, but may be formed in an area of relatively high density or high absorption of light from the emitter of the perf sensor or alternatively, an area of relatively highly reflective material, such that a signal can be generated only when the indicia, such as a perf, goes by the sensor. Starting at the extreme right the first perforation 110, 210 is a common frame synchronizing perforation for use in timing the creation of a first image frame $A_1$ of image size A and also for use in timing the creation of a first image frame $B_1$ of image size B. Image size B has a frame width measured in the direction of movement of the belt that is greater than the corresponding dimension of an image frame used to record an image frame of image size A. The image frame size B is greater than that of A in the longitudinal direction of the belt. As an example B may represent a size sheet of standard B4 size and A may represent a size sheet of standard 8.5"×11" size (216×279 mm) or A4 size (210×297 mm). For the size belt shown in this embodiment, six image frames each of size A (image frames $A_1$–$A_6$) may be recorded or formed during a production run before a splice is encountered and five image frames each of size B (image frames $B_1$–$B_5$) may be recorded or formed before encountering a splice. Each image frame synchronizing perforation is used for causing the writer to record an image frame in the area shown on the belt in FIG. 2 and designated image frame $A_1$ and image frame $B_1$, respectively. Which image size is actually formed on the belt will be determined by the image data record. Of course, certain production jobs may mix sizes of images in a series of images. It will be noted from FIG. 2 near the extreme left end thereof that the left edge of each image frame $A_1$ and $B_1$ starts at the same position and are equally spaced from the splice SP. It will be noted from FIG. 2 that perforation 110, 210 is the only perforation that is common for synchronizing image frames of different sizes. For synchronizing the second image frame or image frame $A_2$, perforation 120 is provided. Similarly, for synchronizing the second image frame of image frame $B_2$ a perforation 220 is provided.

The image frame, which is synchronized off of perforation 120,

The image frame, which is synchronized off of perforation 120, begins before image frame $B_2$, which is synchronized off of perforation 220. The space between a synchronizing perforation (or an edge of a perforation if this is the feature of the perforation that is specifically detected) and the corresponding leading edge of the image frame is generally the same on the belt but need not be. If this distance is constant then the beginnings of image frames $A_2$ and $B_2$ are offset from each other the same amount as the spacing between corresponding parts of perforations 120 and 220. However, the synchronization timing for the image frames of the B series may be different than that of the image frames of the A series.

As can be seen in FIG. 2, a series of perforations 110, 120, 130, 140, 150 and 160 are provided for synchronizing image frames $A_1$, $A_2$, $A_3$, $A_4$ and $A_5$ and $A_6$ respectively. B series perforations to 210, 220, 230, 240, and 250 are provided for synchronizing image frames $B_1$, $B_2$, $B_3$, $B_4$, and $B_5$ respectively. The perforations are located to be in an immediately preceding interframe area when that respective size image frame is formed. This is because the synchronizing of commencement of writing can be relatively quickly done as the next image frame to be written is fully rasterized, stored in a job image buffer memory and sitting and waiting to be output to the writer line by line for printing. As noted in U.S. Pat. No. 5,255,055 various perforation sensors may be placed along the path of the belt to synchronize operations with respective stations. Thus, the transfer station may have its own sensor for sensing a perforation or other frame identifying indicia for synchronizing movement of paper sheets into the transfer station. However, as described below, it is preferred to have a single perf sensor $S_1$ that senses each perforation as they serially pass beneath the sensor and is used by the LCU to control timing functions generally other than paper sheet feeding. An encoder wheel 21*b* operates in response to rotation of roller 21*a* to generate encoder pulses representing increments of movement of the web 18 along its path of movement in what is known as the process direction of the web 18. Upon synchronizing exposure of an image frame at the exposure station 34, the position of the leading edge of that image can be tracked by the LCU through counting of encoder pulses from the time of detection of the perf associated with that image frame. The LCU is programmed to store counts associated with each image frame relative to its movement along the closed path for synchronizing various process operations, such as transfer and, thus, when to feed a receiver sheet into the transfer station.

It is preferred to provide an interframe area in the splice region as shown in FIG. 2 that is larger than that between images at non-splice regions. This allows other operations sufficient time to be operated or stabilized. For example, it may be desirable to reverse bias the transfer roller 46*b* when the interframe passes beneath the transfer area. This is desirably done to preclude toner accumulating at the splice from transferring to the transfer roller as no receiver sheet is between the roller and belt at this time. Because of the capacitance of the roller it may take time for this reverse biasing of this roller to become totally effective.

Figure 4A:
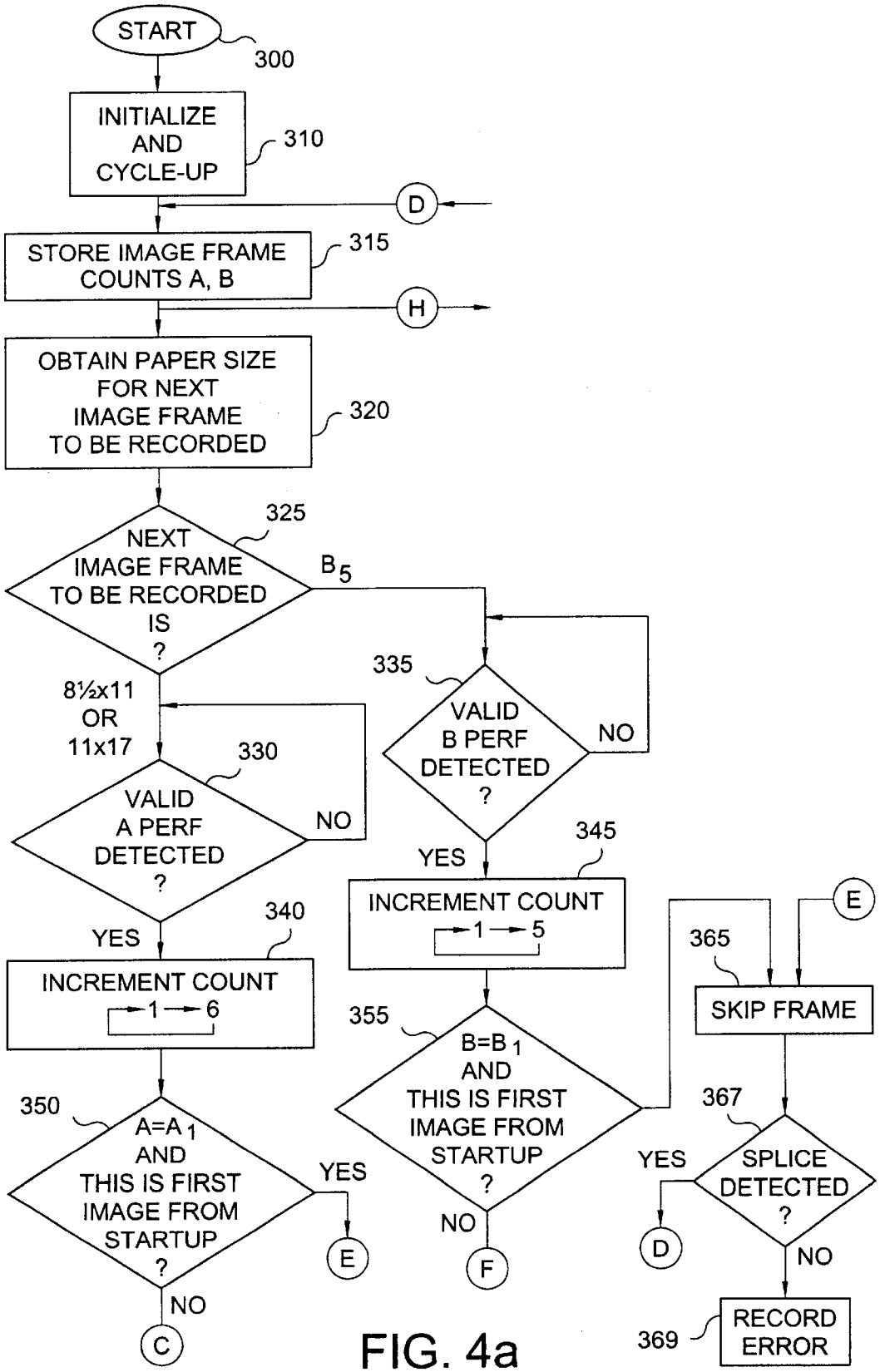
Figure 4B:
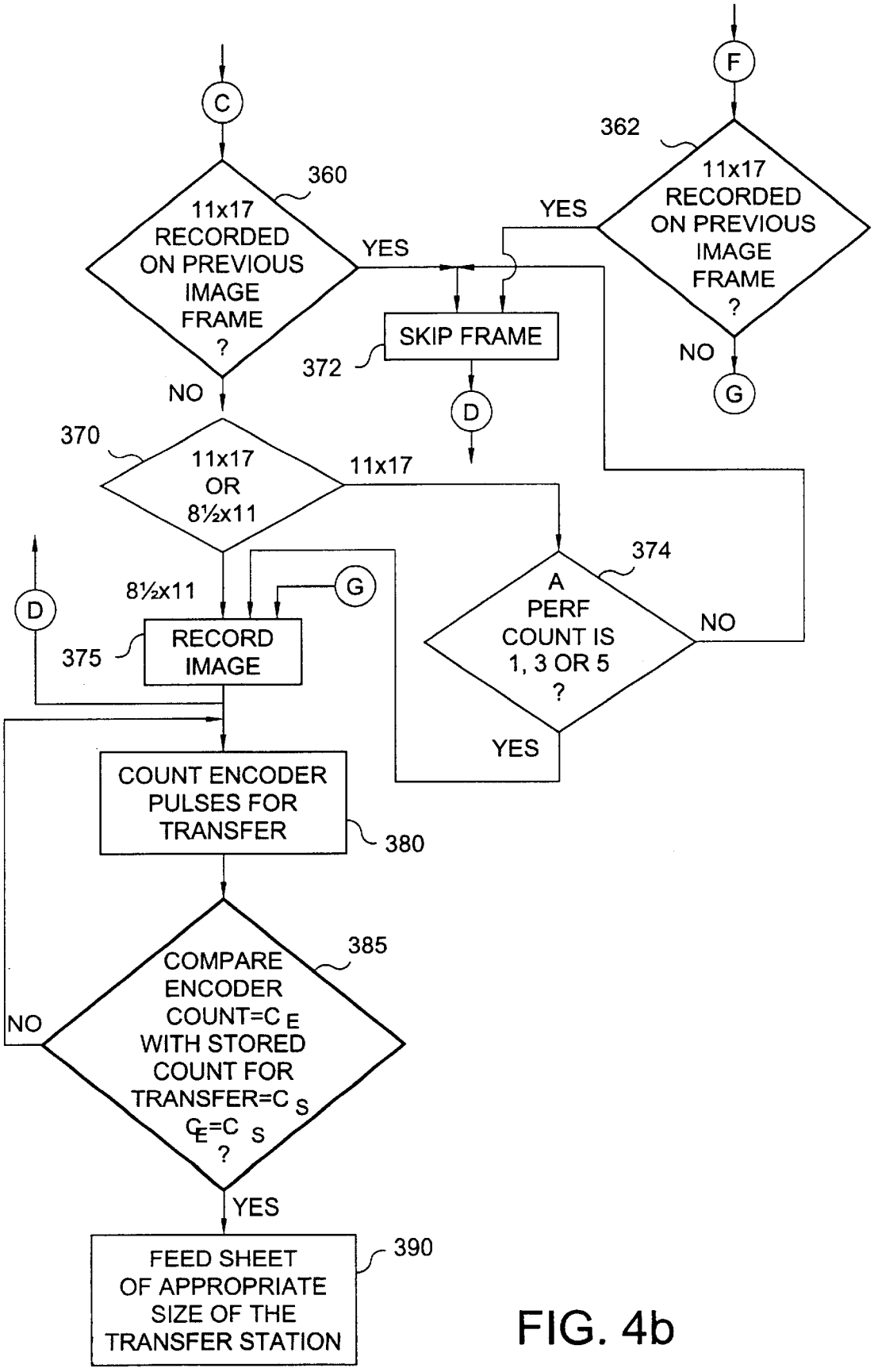

With reference to the flow chart of FIGS. 4*a*, 4*b* and 4*c*, in step 300 the copier/printer is commenced to start and undergoes an initial cycle up procedure 310. In the cycle-up procedure, various registers of memory are initialized and various process stations are made to get ready for operation. The perforation or perf sensor, $S_1$, is activated to detect the various frame perfs and the splice perf in the belt 18. Upon detection of the splice perf, the frame count can be maintained for each of the A and B image perfs that are detected by the perf sensor. As an A perf moves past the perf sensor, the detection of the perf by the sensor creates a signal that is communicated to the LCU and stored as a count in a memory count register of the LCU, and similarly when a B perf moves past the perf sensor, the detection of the perf is stored as a count in another memory register of the LCU. The location of the splice perf defines the location of perfs $A_1$ and $B_1$. The splice perf may be detected by being a predetermined number of encoder pulses from the previous perf. Once the splice perf is detected each succeeding perf of each of groups A and B increments a count in their respective count registers, step 315. In step 320 the paper size to be used to record the next image frame is recalled from memory. In step 325 a determination is made as to whether or not this paper size is B4 or alternatively 8.5"×11" or 11"×17".

In steps 330 and 335 respective determinations are made as to detection of valid A and B perfs respectively. In accordance with such detection, counts in the respective registers are incremented respectively. It will be noted that in step 340 that counts of the A perfs are counted from 1 through 6 and the count then restarts from 6 back to 1. It will be noted that in step 345 that counts of the B perfs are counted from 1 through 5 and the count then restarts from 5 back to 1. In steps 350, 355 respective determinations are made as to whether or not the A or B perf detected is for the first image frame $A_1$ or $B_1$, respectively, and that this is the first image from startup. If the answer to a respective inquiry is yes, a skip frame is introduced, step 365. The reason for not commencing recording on image frame $A_1$ or $B_1$ just after cycle-up is that as noted above the polarity of the voltage bias established on the transfer roller is reversed in the splice interframe area. It is preferred to establish a constant voltage bias on the transfer roller during transfer. During such transfer the current through the transfer roller can be noted by the programmable voltage controller **46*a***. When the interframe upon which the splice is located is positioned beneath the transfer roller, switching of the electrical bias on the transfer roller can be quickly made by operating the transfer roller in a constant current mode whereupon the current of the same magnitude during transfer is now reversed in polarity to thereby establish on the transfer roller a reverse electrical voltage bias to repel the charge on the toner particles. In this regard reference is made to U.S. application Ser. No. 08/841,008 filed on Apr. 29, 1997 in the names of Ziegelmuller et al, the contents of which are incorporated herein by reference. After the splice interframe has passed through the transfer station, the transfer roller can be quickly electrically biased to the correct voltage potential by the power supply controller's switching to a current of a reverse polarity so that the transfer roller is correctly biased to an electrical voltage potential used during a prior transfer operation. However, during startup there is no prior transfer operation to serve as a reference for switching in a constant current mode. When the image loop is operating at high-speed, there is insufficient time for the appropriate voltage potential to develop on the transfer roller and thus toner image recording on the first image frame adjacent the splice interframe is advantageously avoided when recording is to begin just after cycle-up. Recording is thus begun just after cycle-up at the next available image frame downstream of the first image frame or at any appropriate image frame other than the first image frame. Recording of a first image is preferably inhibited by the controller at image frames $A_1$ or $B_1$ just after cycle-up by not exposing the image frame to image information.

Assuming the answer is yes in either of steps 350 or 355, as applicable, upon detection of the splice perf, step 367, the process returns as indicated to step 315 to look for the next image frame perf. If no splice is detected by the sensor, an error may be logged, step 369.

If the answer to the respective inquiries in steps 350, 355 is no, inquiry is then made in steps 360 and 362 as to whether or not an 11"×17" image has commenced to be recorded on a previous image frame. The reason for this is that such recording would tend to also overlap with the present image frame. If the answer to this inquiry is yes, a skip frame is introduced, step 372. If the answer to the respective inquiry in step 360 is no, then in step 370 a determination is made as to whether or not the next image to be recorded is 8.5"×11" or 11"×17" in size. If the answer to the inquiry in step 370 is 8.5"×11", the image is recorded, step 375. If the answer to the inquiry in step 370 is 11"×17", a determination is made in step 374 as to whether or not the current A perf count is 1, 3 or 5. The reason for this is that for recording of an 11"×17" image, such recordings are only begun on the noted image frames to avoid recording of any part of such image upon the splice area. If desired, recording of an 11"×17" image may be commenced at image frames $A_2$ and $A_4$ in certain cases such as at startup when recording on image frame $A_1$ is not made.

As some printing jobs may require mixed papers, the larger paper occupying more than one imaging frame (e.g. 11"×17" paper used where normal image frame size is 8.5"×11"), the imaging process is controlled such that printing of the larger frames starts with frames $A_1$, $A_3$ and $A_5$ only. The control unit applies the aforementioned rules for printing larger images continuously during the production run and inserts, if necessary, one or more skip frames so that printing of the larger sized image is in accordance with the above criteria.

As the perf for recording of the next image frame is sensed, an encoder counts encoder pulses for purposes of determining when that image frame will appear at the transfer station, step 380. Alternatively, as noted above, separate perf detectors may be provided at various process stations including the transfer station to synchronize operation of that respective station, in this regard reference is made to U.S. Pat. No. 5,255,055 (Mahoney), the contents of which are incorporated herein by reference. For each image frame recorded, a comparison is made by the LCU of the current encoder count $C_E$ with a stored count, $C_S$, representing a nominal number of encoder counts until that recorded interframe enters the transfer station, step 385. When there is a match of the stored count with that of the current encoder count, a receiver sheet is synchronously moved into the transfer station and pressed by the transfer roller against the toned image to transfer the toned image to the receiver sheet as described above, step 390. Where a separate perf detector and encoder are provided at the transfer station, the steps 380, 385 and 390 may be with regard to counts by the encoder at the transfer station in relation to sensing of the appropriate frame perf by the sensor at the transfer station.

As noted above, the electrical bias on the transfer roller is switched from the polarity suited for attracting toner to a receiver sheet to a polarity suited for repelling toner from being attracted to the transfer roller during the passage of the splice interframe beneath the transfer roller. In step 316, a determination is made of the frame count to determine whether or not the image frame entering the electrostatic image recording station is $A_1$ or $B_1$. Note that the interframe just ahead of image frames $A_1$ and $B_1$ is the splice interframe. If the answer is no, the process returns to step 315. If the answer is yes, a count of encoder pulses is made, step 317. In step 318, a comparison is made of a stored encoder count CTR1 which is a predetermined count for determining when that image frame will move from the electrostatic image exposure station to when the transfer of the image to the receiver is completed. When the count of encoder pulses matches this predetermined count a reverse voltage bias is provided by the programmable voltage controller to the transfer roller as described herein, step 319. The count of encoder pulses may continue, step 321, and be compared with a second predetermined count CTR2 to determine if the splice interframe has passed through the transfer station, step 322. When it is determined from the counting of encoder pulses that the splice interframe has passed through the transfer station the normal voltage bias to the transfer roller which is used for transfer can be restored to the transfer roller, step 323. It will be appreciated that as there are predetermined spacings between perfs, a combination of perf count and encoder counts may be used to determine movement of an image frame or interframe from the electrostatic image recording station to other stations such as the transfer station.

The splice interframe may also be used for periodically recording of toned process control patches. An example of a process control system that employs recorded and developed process control patches in an electrophotographic system is described in U.S. Pat. No. 5,987,271. Alternatively, process control patches may be recorded in interframes, other than the splice interframe. When recorded in such other interframes, provision is preferably made to reverse bias the transfer roller so as to repel and thereby minimize pickup of toner particles by the transfer roller of the electrostatically charged toner particles in the developed patch areas. Where an interframe is used to record one or more process control patches, provision is also made not to record an image that would extend into the interframe area where the patch is recorded. Thus, for example, because an 11"×17" size image would extend across at least one interframe that interframe is not used to record a control patch if an 11"×17" image was commenced to be recorded in the prior image frame to that interframe. Additionally, if the belt is operated at high speed and the interframe area is relatively short, it may be desirable to impose a skip frame to allow voltage on the transfer roller to be reverse biased so as not to have the toner patch transfer to it and then returned to normal voltage bias for transfer as described above. It will also be noted for the embodiments of image loops having A and B perforations that there is some overlap in an interframe area of one size image with that of another size image. It is, thus, desirable to avoid the recording of process control patches in an interframe where an image of one size is recorded after recording an image of a different size.

Figure 5:
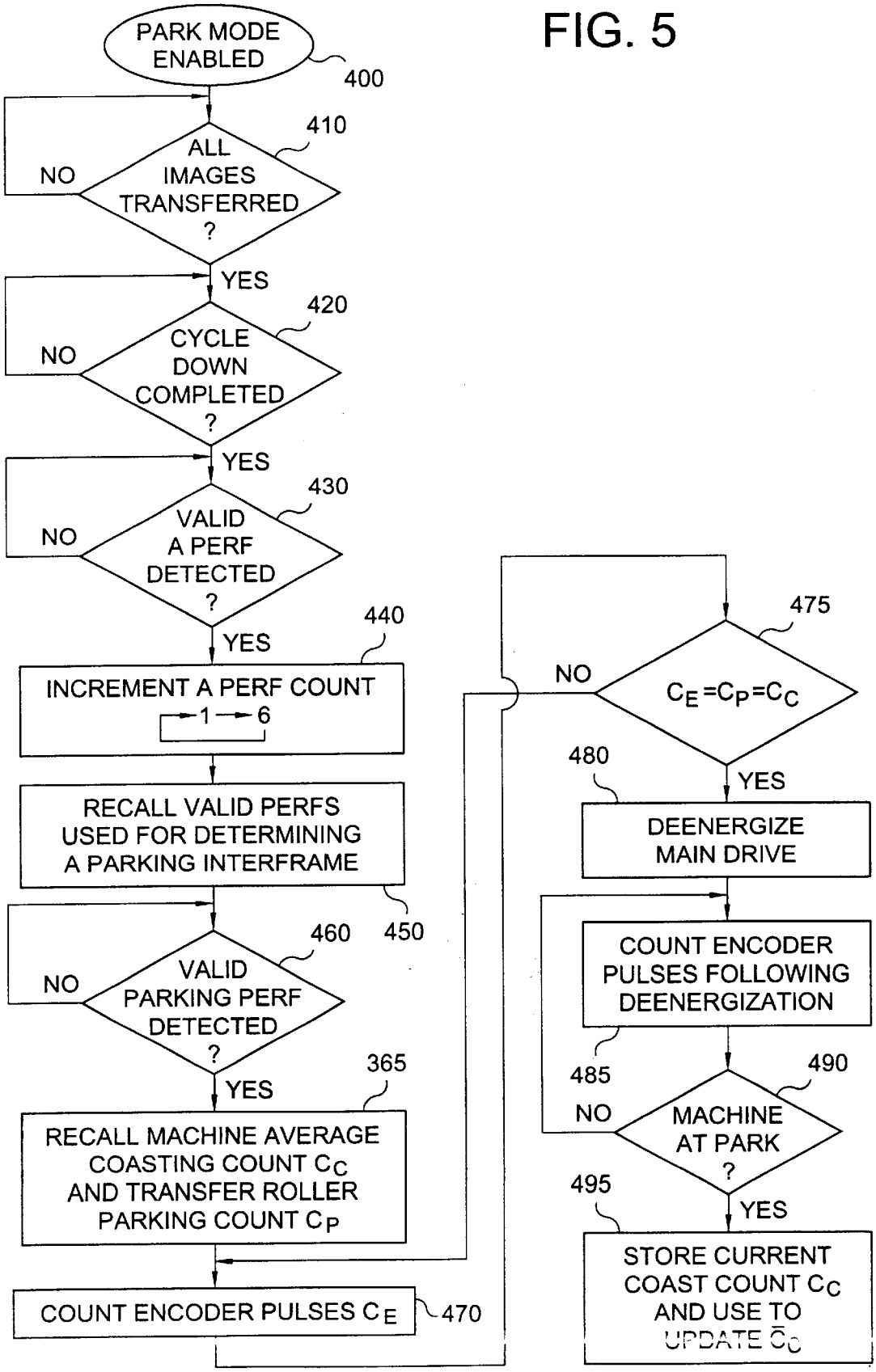
FIG. 5 is a flow chart illustrating steps of control of the machine of FIG. 1 for parking of a transfer roller at an interframe location.
Figure 10:
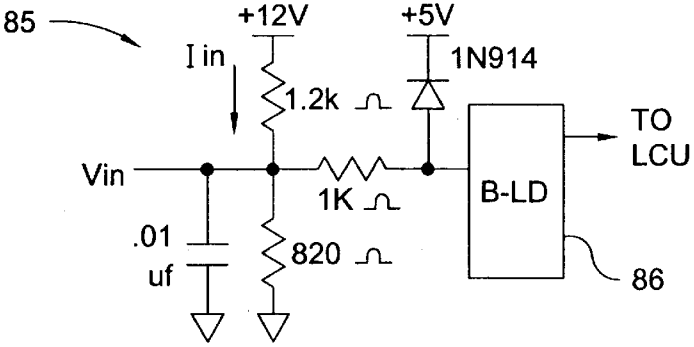
FIG. 10 is a circuit for use with the perforation sensor of FIGS. 7–9.

With reference now to the flow chart FIG. 5, the LCU is also programmed to cause the transfer roller to be parked when the image loop is stopped with the transfer roller resting in engagement with the interframe area containing the splice. The advantage of doing this is that there is thereby avoided the transfer-line parking artifact. In step 400, the parking mode is enabled by the machine determining that it should cycle out. As is well known this can happen to a copier/printer apparatus through a predetermined time of non-use of the machine or by the machine being turned off. The LCU determines in step 410 whether or not all images have been transferred. If the answer is yes, the various process stations are placed into a cycle down mode and determination is then made with regard to the various process stations as to whether or not the cycle down mode is complete, step 420. During the cycle down operation, the various perforations in the image loop are sensed and perf counts continue to be recorded, steps 430 and 440. In steps 450 and 460, a determination is made as to whether or not a valid perf is detected for use in determining an interframe for parking the transfer roller. The preferred interframe, as noted above, is the splice interframe. However, any of the interframes not used for recording an 11"×17" image such as interframes immediately preceding frames $A_1$, $A_3$ or $A_5$, respectively, may be used. If a valid parking perf is detected, the controller recalls from nonvolatile memory a count $\overline{C}_c$ representing the average coasting of the image loop after the motor is deenergized. This count is in terms of expected encoder pulses for such coasting and is updated after each machine cycle down. Also recalled from memory is the expected number of encoder counts between detection of the valid parking perf and the parking location, $C_P$, step 465. When the valid parking perf is detected, encoder pulses are counted, step 470, and compared with a count, $C_P$, stored in the LCU's memory, step 470. The count $C_P$ represents the expected encoder count for movement of the image loop from where the valid perf is first sensed until the image loop location having, for example, the splice interframe moves into the transfer station to the position where the transfer roller is desired to be parked against the image loop. The time for deenergizing the motor drive to the image loop is determined by having the parking count $C_P$ adjusted by the average coasting count $\overline{C}_c$. Thus, the encoder pulse counts are compared with $C_P-\overline{C}_c$, step 475. When this count is reached, the motor main drive is deenergized, step 480, and the image loop will coast until the transfer roller is correctly parked in the appropriate interframe. As the interframe area containing the splice is not used for recording images, there is thus minimized the creation of the transfer-line parking artifact on any images. However, if it is desired to park the transfer roller in an interframe area other than the splice interframe area, the process described for doing such is similar to that described for use of parking in the splice interframe.

Following deenergization of the motor main drive to the image loop, a count of encoder pulses is made to determine a count of how many encoder pulses were generated between deenergization and parking or stopping of the image loop, steps 485, 490. The current count is then used to update an updated average count $\overline{C}_c$ 495.

Figure 3:
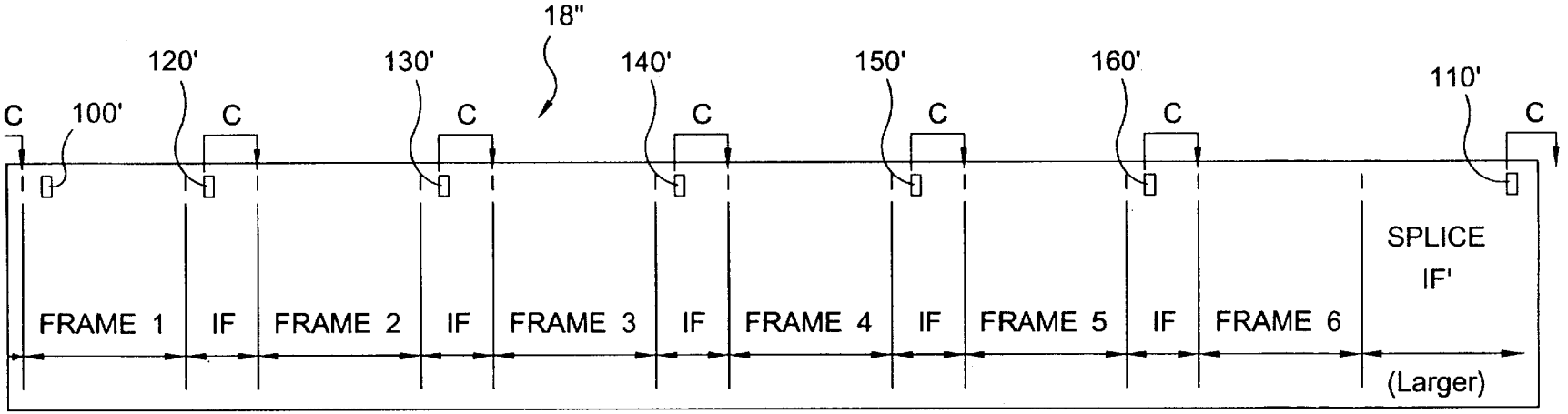
FIG. 3 is a schematic representation of a second embodiment of a photoconductive belt of the invention that has been cut at the seam so that the belt may be shown in a flat condition.

In the flow charts of FIGS. 4 and 5, operation thereof with use of the image loop of FIG. 3, which has no B perfs, is also pertinent by just considering the process in conjunction with only providing for A perforation counts. In FIG. 3, an example of an endless photoconductive imaging belt is illustrated which only includes a series of A image frame perfs, the perforations corresponding to the A frame perfs of FIG. 2 are identified with a similar numeral with a single prime (').

As an alternate embodiment to FIG. 3, a photoconductive belt may be provided wherein the frame synchronizing perfs may be uniformly spaced from each other so that there is provided an interframe area that includes the splice that is equal in size to that of the other interframe areas.

It may be desired to locate the seam when the apparatus is stopped so that the seam is at a location other than the transfer location. A count may be stored in memory for such a location and substituted for the count used to park the seam at the transfer location when, for example, a service technician wishes to have the seam be at that other location for analysis.

Figure 6:
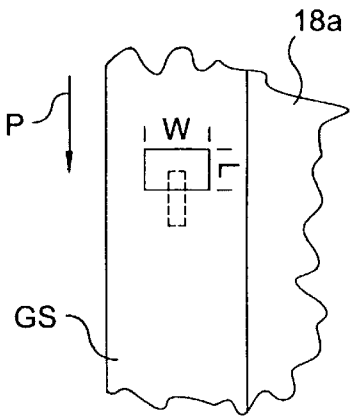
FIG. 6 illustrates a portion of a photoconductive belt in accordance with the invention herein and having a synchronizing perforation formed therein.
Figure 9:
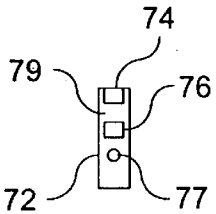
FIGS. 7–9 are side elevational, plan and front elevational views, respectively, of a perforation sensor for use with the apparatus of the invention.
Figure 8:
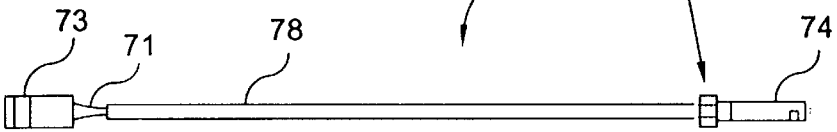
Figure 7:
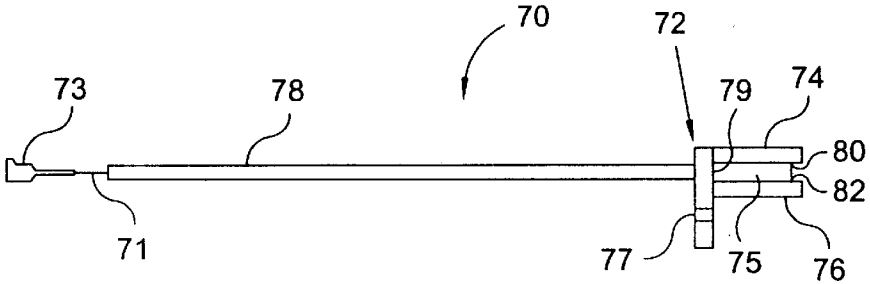

With reference now to FIGS. 7–10, there is shown a preferred embodiment of a perf detector 70 that is employed to sense a perforation moving past the detector and generate a signal upon passing of an edge of the perforation between the source and receiving portions of the detector. As noted above, the perfs are preferably located in the ground stripe which is generally absorptive of infrared radiation. A perf detector, as is well known, is adapted to generate an infrared beam that can be sensed by a receiver portion or light sensor of the detector only when the beam is allowed to transfer through an opening in the ground stripe. The perf detector has a tower, 72, from which arms, 74 and 76, cantileveredly extend. The arms have surfaces spaced from each other so that between the arms a film transport slot, 75, is defined within which an edge of the film belt is transported. In the arm, 74, there is provided a source of light, 80, such as an LED that generates a continuous or highly repetitively pulsed beam of infrared light towards a sensor or light receiver, 82, located in the opposite arm 76 and facing the LED. The beam is typically blocked from reaching the light receiver by presence of the film and ground stripe GS coated thereon. The tower and arms can be made of a plastic which will transmit infrared light. The perf is detected as the film belt edge advances past the detector because light is free to pass to the sensor or receiver when the leading edge of the perf passes through the detector. To reduce the likelihood that scratches in the ground stripe are detected as a perf, it is desirable to provide the beam aperture to be relatively narrow relative to the width of the perforation. Thus, as shown in FIG. 6, a perf width W of about W=0.35 inches is provided taken in a direction perpendicular to movement of the belt. The sensor's aperture width is about 1/35 that of the perf or about 0.01 inches wide. The length, L, of a perf in this example is about L=0.08 inches. The sensor aperture length is desirably 0.05 inches. The LED emitter aperture may be a square of dimension of about 0.05 inches. When a perf edge is between the sensor or receiver and the LED emitter, the light detected by the sensor or receiver generates a signal which is conveyed by a wire in a wiring assembly, 71, that is detected by a circuit 85, such as that shown in FIG. 10. The wiring assembly, which includes the LED enabling wires is connected by a connector, 73, to the circuit which can be part of a logic and control board. A PVC sleeve, 78, protects the wiring assembly. The circuit, 85, upon presence of a perf generates a near short condition at $V_{in}$ that reduces the potential input to a buffer-line driver 86 from about 5 volts to near zero volts. This causes the buffer-line driver, 86, to generate a digital input to the LCU that a perf is detected. A preferred buffer-line driver is made by Integrated Device Technologies such as IDT74FCT541ASO.

The perf detector tower, 72, is supported on the frame of the machine and the wall 79 is positioned so that the light beam for the LED emitter is centered on the perf and perpendicular to the movement P of the belt at that location. The cantilevered arms 74 and 76 are longer than the distance between the edge of the belt 18 and the centerline through all perfs parallel to the edge of the film so that the belt edge does not touch the wall 79. An opening, 77, in the tower wall can be provided to allow a snap in connector to secure the sensor to the machine frame.

Although the invention is described with reference to a PIFM having a splice or a seam, the invention is also applicable to a PIFM that is seamless.

The invention has been described in detail with particular reference to certain preferred embodiments thereof, but it will be understood that variations and modifications can be effected within the spirit and scope of the invention.

What is claimed is:

1. An electrostatographic recording apparatus comprising:

a primary image forming member (PIFM) moving along a closed path, the PIFM including a seam;

a toner image recorder that forms toner images on the PIFM during a production run of image formation;

a transfer device in engagement with the PIFM for transferring the toner images from the PIFM; and a controller that is programmed to control movement of the PIFM during a cycle-down of the apparatus so that the PIFM is stopped in a position where the transfer device is parked on or near the seam.

2. The apparatus of claim 1 wherein the transfer device is a roller, and during a production run the transfer device is electrically biased to a first voltage polarity for transferring images from the PIFM and to a second voltage polarity that is of a polarity opposite to the first polarity when the transfer device engages an area of the PIFM at or near the seam.

3. The apparatus of claim 2 wherein the PIFM is sufficiently large to form a series of images thereon in the direction of movement of the PIFM during a production run of image formation.

4. The apparatus of claim 1 and including a source of electrical bias for biasing the transfer device to a voltage of a first polarity when transferring the toner images from the PIFM and for electrically biasing the transfer device to a voltage of a second polarity that is of a polarity opposite to the polarity of the first polarity during production runs when the transfer device engages an area of the PIFM at or near the seam.

5. The apparatus of claim 4 wherein the PIFM is sufficiently large to form a series of images thereon in the direction of movement of the PIFM during a production run of image formation.

6. The apparatus of claim 1 wherein the PIFM is sufficiently large to form a series of images thereon in the direction of movement of the PIFM during a production run of image formation.

7. The apparatus of claim 6 wherein the PIFM is a belt.

8. The apparatus of claim 6 wherein the PIFM is a drum.

9. A method of recording with an electrostatographic recording apparatus, the method comprising:

moving a primary image forming member (PIFM) along a closed path;

forming toner images on the PIFM during a production run of image formation;

transferring the toner images from the PIFM by engaging the PIFM with a transfer device wherein the transfer device is electrically biased during production runs to a voltage of a first polarity when transferring images from the PIFM, and is electrically biased to a voltage of a second polarity that is a polarity opposite to the first polarity when the transfer device is at the predetermined location on the PIFM when the PIFM is moving during the production runs; and providing a cycle-down of the apparatus to stop movement of the PIFM, the PIFM being stopped to park the transfer device in a predetermined location on the PIFM.

10. The method of claim 9 wherein the PIFM is sufficiently large to form a series of images thereon in the direction of movement of the PIFM during a production run of image formation.

11. The method of claim 10 wherein the predetermined location is at or near a seam.

12. The method of claim 9 wherein the predetermined location is at or near a seam.

13. The method of claim 9 wherein the predetermined location is at or near a seam.

* * * * *